US011358791B1

(12) United States Patent
Alberson

(10) Patent No.: US 11,358,791 B1
(45) Date of Patent: Jun. 14, 2022

(54) EZ FILL BAG HOLDER

(71) Applicant: Owen Lee Alberson, Theodore, AL (US)

(72) Inventor: Owen Lee Alberson, Theodore, AL (US)

( * ) Notice: Subject to any disclaimer, the term of this patent is extended or adjusted under 35 U.S.C. 154(b) by 0 days.

(21) Appl. No.: 17/178,885

(22) Filed: Feb. 18, 2021

Related U.S. Application Data

(60) Provisional application No. 63/205,387, filed on Dec. 7, 2020.

(51) Int. Cl.
*B65F 1/14* (2006.01)
*B65B 67/12* (2006.01)

(52) U.S. Cl.
CPC ..... *B65F 1/1415* (2013.01); *B65B 67/1233* (2013.01); *B65B 67/12* (2013.01); *B65F 2240/138* (2013.01)

(58) Field of Classification Search
CPC ..... B65F 1/1415; B65F 2240/138; B65F 1/1468; B65F 1/141; B65B 67/1205; B65B 67/12; B65B 67/1255; B65B 67/1227; B62B 3/106; B62B 2202/22; A47F 9/042; A47F 13/085
See application file for complete search history.

(56) References Cited

U.S. PATENT DOCUMENTS 62,332 A * 2/1867 Heyden ..... B65F 1/1415 248/97
228,733 A * 6/1880 Curtis et al. ..... B65F 1/1415 248/98
307,698 A * 11/1884 Yengling ..... B65B 67/1227 248/100
666,045 A * 1/1901 Beeson ..... B65F 1/1415 248/97
868,504 A * 10/1907 Taylor ..... B65B 67/1227 248/100
998,291 A * 7/1911 Heyd ..... B65F 1/1415 248/101
1,502,597 A * 7/1924 Taylor ..... B65B 67/1227 248/97
1,640,084 A * 8/1927 Leicht Jr. ..... A47F 13/085 221/55
1,713,095 A * 5/1929 Scheffler ..... B62B 3/008 248/101
1,783,749 A * 12/1930 Roehl ..... B65B 67/1227 248/97
1,868,269 A * 7/1932 Beadle ..... B01D 29/27 248/94
1,894,597 A * 1/1933 Murray ..... A47F 9/042 211/51
1,923,816 A * 8/1933 Firl ..... B65B 67/12 248/97
2,305,863 A * 12/1942 Ginter ..... B65B 67/1227 248/100

(Continued)

*Primary Examiner* — Muhammad Ijaz
*Assistant Examiner* — Taylor L Morris

(57) ABSTRACT

A device whose purpose is to hold a lawn trash bag upright and open for easy fill up with leaves, lawn clippings, recyclables, or any yard or beach debris and clean up. It holds up to a 55 gallon capacity. It is constructed of heavy, durable plastic yet is light weight and easy to manage. It consists of four interlocking pieces to assemble for use and disassemble for storage.

1 Claim, 3 Drawing Sheets

(56) References Cited

U.S. PATENT DOCUMENTS 2,513,630 A * 7/1950 Elliott ..... B65F 1/1623 248/147
2,995,329 A * 8/1961 Talcott, Jr. ..... B65B 67/1255 248/97
3,197,032 A * 7/1965 Stanley ..... B65F 1/1421 211/83
3,224,595 A * 12/1965 Sherley ..... B65F 1/1421 211/83
3,288,306 A * 11/1966 Walters ..... B65F 1/141 211/85.19
3,625,370 A * 12/1971 Mintz ..... B65F 1/141 211/85.19
3,768,763 A * 10/1973 Hembree ..... B65B 67/12 248/97
3,866,872 A * 2/1975 Burgess ..... B65B 67/1227 248/97
3,870,261 A * 3/1975 McSwain ..... B65F 1/1415 248/101
3,893,699 A * 7/1975 Morris ..... B62B 3/106 280/659
4,304,378 A * 12/1981 Briggs ..... B65B 67/1255 248/150
4,312,489 A * 1/1982 Paetzold ..... B65B 67/12 248/97
4,313,612 A * 2/1982 Rubens ..... B62B 3/04 280/79.5
4,376,520 A * 3/1983 Wetherington ..... B65B 67/1233 248/150
4,620,683 A * 11/1986 Claydon ..... B65B 67/1227 248/431
4,667,911 A * 5/1987 Farris ..... B65F 1/1415 248/101
4,669,689 A * 6/1987 Jones ..... B65B 67/1227 248/152
4,695,020 A * 9/1987 Collins ..... B65B 67/1227 248/100
4,708,307 A * 11/1987 Daigle ..... B65B 67/12 248/95
4,723,803 A * 2/1988 Sapp ..... B65B 67/1238 294/214
4,741,494 A * 5/1988 Voornas ..... B65F 1/141 211/85.19
4,749,158 A * 6/1988 Buckley ..... B62B 1/12 248/129
4,750,695 A * 6/1988 Greenhouse ..... B65F 1/1415 141/391
4,856,740 A * 8/1989 MacLeod ..... B65B 67/1205 248/97
4,899,967 A * 2/1990 Johnson ..... B65B 67/12 248/97
4,940,201 A * 7/1990 Kurth ..... B65B 67/12 248/101
5,012,994 A * 5/1991 Keefe ..... B65B 67/1227 248/302
5,031,948 A * 7/1991 Groth ..... B65B 67/1233 294/214
5,036,893 A * 8/1991 DeCrane ..... B65B 67/1227 141/114
5,074,500 A * 12/1991 Loebbert ..... B65F 1/1415 248/99
5,127,538 A * 7/1992 Bach ..... B65F 1/06 220/475
5,139,219 A * 8/1992 Navarro ..... B65B 67/12 248/156
5,195,649 A * 3/1993 Wolters ..... B65F 1/1415 220/263
5,228,654 A * 7/1993 Carpentier ..... B65B 67/1227 248/100
5,232,274 A * 8/1993 Johan ..... B65F 1/1415 248/101
5,456,431 A * 10/1995 Llnisky ..... B62B 3/02 248/150
5,499,787 A * 3/1996 Bonomo ..... B65B 67/1222 248/188
5,588,622 A * 12/1996 Gordon, Sr. ..... B65B 67/1238 24/30.5 R
5,641,138 A * 6/1997 Cronk ..... B65B 67/1233 248/101
5,711,563 A * 1/1998 Sapp ..... B65B 67/1233 248/99
5,735,494 A * 4/1998 Kurk ..... B65F 1/1415 248/97
5,765,789 A * 6/1998 Ryon ..... B65B 67/1227 248/166
5,826,838 A * 10/1998 Forbes ..... B65B 67/1227 248/97
5,836,553 A * 11/1998 Bergaila ..... B65B 67/1233 248/99
5,899,419 A * 5/1999 Ross ..... B65B 67/1238 248/97
6,431,503 B1 * 8/2002 Horan ..... B65B 67/1255 248/101
6,488,241 B1 * 12/2002 Kyte ..... B65B 67/1216 248/95
6,543,732 B1 * 4/2003 Yuan ..... B65B 67/1205 248/101
6,676,092 B2 * 1/2004 Tsai ..... B65F 1/1415 248/173
6,691,959 B1 * 2/2004 Dancy ..... B65B 67/1205 248/100
6,705,575 B1 * 3/2004 Hoy ..... B65B 67/1233 248/97
7,284,732 B1 * 10/2007 Lopa ..... B65F 1/1415 248/101
7,530,537 B2 * 5/2009 Kandah ..... B65B 67/1216 220/482
7,703,723 B1 * 4/2010 Cooper ..... B65B 67/1205 248/97
7,753,322 B1 * 7/2010 Peterson ..... B65B 67/1233 248/99
8,091,840 B1 * 1/2012 Ortiz-Torres ..... B65F 1/1415 248/97
8,109,477 B1 * 2/2012 Blasbalg ..... B65F 1/004 248/98
8,210,485 B2 * 7/2012 Scobey, Jr. ..... B65F 1/1415 248/99
8,720,834 B2 * 5/2014 Scobey, Jr. ..... B65D 33/06 248/97
8,752,724 B2 * 6/2014 Babikian ..... B65F 1/1415 220/495.11
8,770,454 B1 * 7/2014 Lutz ..... B65F 1/1468 224/625
8,834,023 B1 * 9/2014 Laera ..... B65D 33/007 383/33
8,888,054 B1 * 11/2014 Peterson ..... B62B 1/14 248/97
9,290,194 B1 * 3/2016 Catinchi ..... B65F 1/1415
9,676,550 B2 * 6/2017 Koo ..... B65B 67/1255
10,017,198 B1 * 7/2018 Stamper ..... B65F 1/1468
10,099,855 B1 * 10/2018 Higgins, II ..... B65F 1/1415
10,196,202 B1 * 2/2019 Clavizzao ..... B60N 3/08
10,351,339 B1 * 7/2019 Moens ..... B65B 67/1233
10,384,868 B1 * 8/2019 Poulopoulos ..... F16M 11/26
10,435,240 B1 * 10/2019 Stroop ..... B65F 1/1415
10,464,717 B1 * 11/2019 Rosenshine ..... B65D 33/007
10,787,313 B1 * 9/2020 Hogan ..... A47L 13/52
2003/0111853 A1 * 6/2003 Rheinhardt ..... B65F 1/1415 294/214
2003/0178536 A1 * 9/2003 Tsai ..... B65F 1/1415 248/97
2004/0222333 A1 * 11/2004 Quick ..... B65F 1/1415 248/99
2005/0061929 A1 * 3/2005 Wood ..... B65F 1/10 248/99
2005/0178736 A1 * 8/2005 Wilfong ..... B65D 83/08 211/59.1
2005/0199767 A1 * 9/2005 Gilbert ..... B65F 1/1415 248/97

(56) References Cited

U.S. PATENT DOCUMENTS

2006/0102809 A1* 5/2006 Breeders ..... B65B 67/1266 248/95
2006/0175475 A1* 8/2006 Desantis ..... B65F 1/1415 248/99
2007/0114343 A1* 5/2007 Slone ..... B65F 1/141 248/146
2007/0235600 A1* 10/2007 Herold ..... B65F 1/1415 248/97
2008/0128565 A1* 6/2008 Kandah ..... B65B 67/1233 248/304
2009/0014603 A1* 1/2009 Zima ..... B65F 1/1415 248/101
2009/0046955 A1* 2/2009 Schember ..... B65D 33/007 383/33
2009/0152825 A1* 6/2009 Adams ..... B65F 1/1468 280/47.31
2009/0230258 A1* 9/2009 McFadden ..... B65B 67/1233 248/101
2010/0140423 A1* 6/2010 Davies ..... B65F 1/1415 248/101
2011/0079987 A1* 4/2011 Wu ..... B62B 3/106 280/655
2011/0219962 A1* 9/2011 Ivkovic ..... B30B 9/3053 100/265
2013/0001377 A1* 1/2013 Reiss ..... B65B 67/1205 248/97
2013/0221694 A1* 8/2013 Scobey, Jr. ..... B65F 1/1415 294/31.2
2013/0232923 A1* 9/2013 Beversluis ..... A45F 5/00 53/492
2013/0256314 A1* 10/2013 Marconi ..... B65F 1/1415 220/495.09
2014/0061400 A1* 3/2014 Sanderson ..... B65B 67/1205 248/97
2014/0262553 A1* 9/2014 Pollock ..... A61B 5/02042 177/1
2014/0353315 A1* 12/2014 Prosa ..... B65F 1/1415 220/495.08
2015/0232267 A1* 8/2015 Leach ..... B65F 1/1415 248/101
2016/0264343 A1* 9/2016 Moulton ..... B65B 43/54
2017/0107054 A1* 4/2017 Lupo ..... B65B 67/1238
2017/0113826 A1* 4/2017 Ristoski ..... B65B 67/1233
2017/0291789 A1* 10/2017 Wong ..... B65F 1/1415
2017/0362029 A1* 12/2017 Dale ..... B65F 1/1415
2018/0368933 A1* 12/2018 Henniges ..... A61B 50/36
2019/0210756 A1* 7/2019 Lucas ..... B65B 67/1233
2021/0070543 A1* 3/2021 Breeze ..... B65B 67/1233
2021/0198036 A1* 7/2021 Kuhl ..... B65F 1/1415

* cited by examiner

EZ FILL BAG HOLDER

CROSS REFERENCE TO RELATED APPLICATIONS

The present application claims priority to U.S. Provisional Patent Application Ser. No. 63/207,387, filed Dec. 7, 2020, the entirety of which is incorporated herein by reference.

BACKGROUND OF THE INVENTION

The present invention relates generally to a bag holder; and more specifically to a bag holder to hold a lawn trash bags.

BRIEF SUMMARY OF THE INVENTION

The present invention's purpose is to hold a lawn trash bag upright and open for easy fill up with leaves, lawn clippings, recyclables or any yard or beach debris. It will hold up to a 55 gallons capacity and is constructed of durable plastic yet that is light weight and easy to manage, it consists of four interlocking pieces to assemble for use and disassemble for storage.

DETAILED DESCRIPTION

The invention will now be described more fully with reference to the accompanying drawings. Dimensions of the components of the invention are in inches, unless indicated otherwise, indicated by the abbreviation (").

Figure 1:
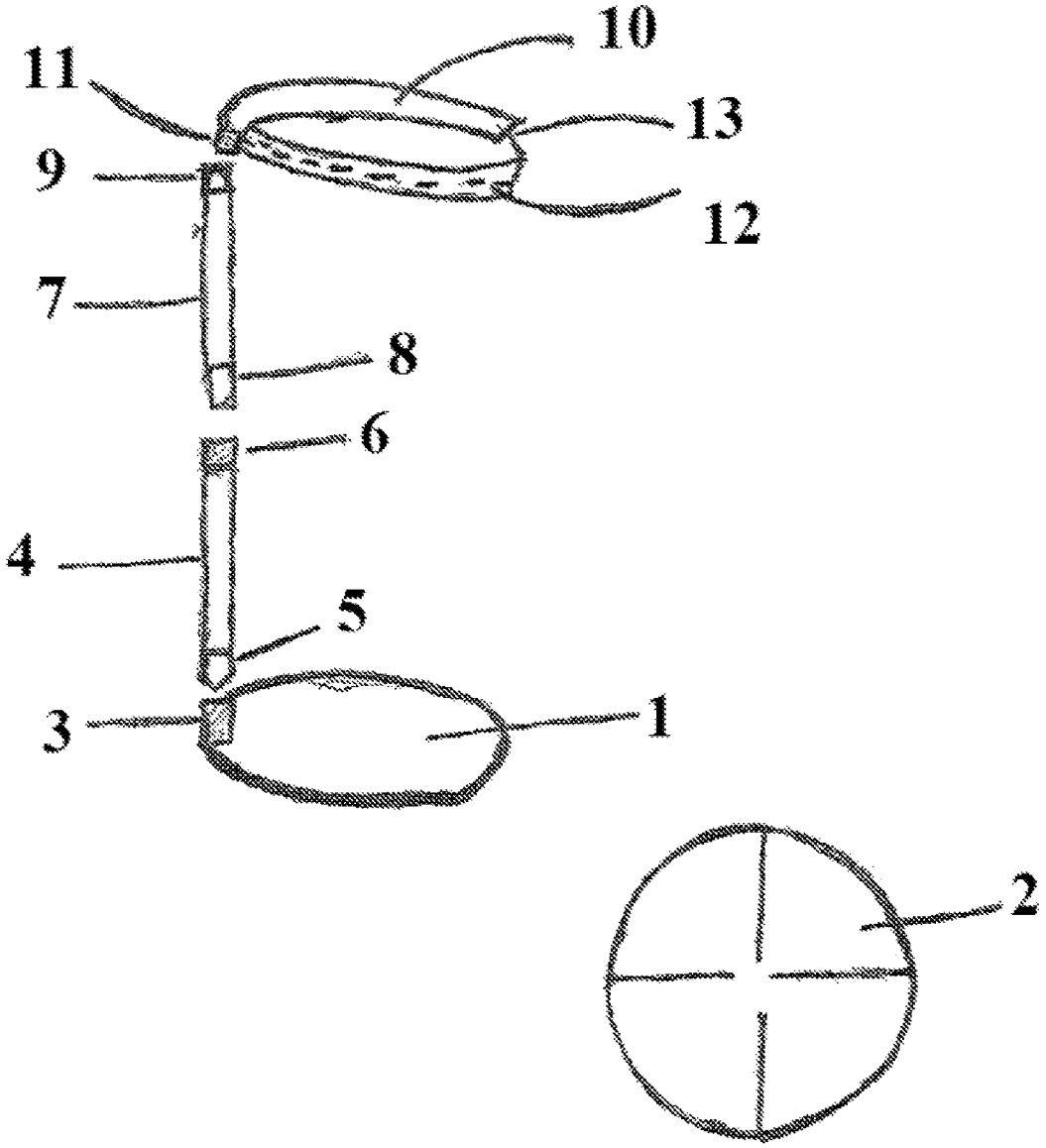
FIG. 1 is an exploded view of the present invention as well as a bottom view of the baseplate.

Referring to FIG. 1, a bag holder is illustrated in an exploded view and a bottom view, respectively. The bag holder comprises an 18"×1.5" round baseplate 1 having a countersunk bottom and a 2.5"×1.5"×2.5" female socket 3 at a back portion of the baseplate. The female socket 3 receives a 2.5"×1.5'×2.5" male socket insert 5 at a bottom end of a 2.5"×1.5"×17" bottom vertical support 4. The bottom vertical support 4 has a 2.5" deep female socket 6 at a top end into which is inserted a 2.5"×1.5"×2.5" male socket insert 8 at a bottom end of a 2.5"×1.5"×17" top vertical support 7. At a top end of the top vertical support 7, there is another 2.5"×1.5"×2.5" male socket insert 9 which is received by a 2.5"×1.5"×2.5" female socket 11 on a back of an 18"×3" top collar 10 which has an 0.5" wide external groove for receiving a 56.5" stretching lock strap 12. The top collar 10 has a throat opening 13 for easy insertion and removal of a plastic bag, wherein a top of the throat opening is 6" wide and a bottom of the throat opening is 10" wide, such that the opening comprises two slanted edges.

Figure 2:
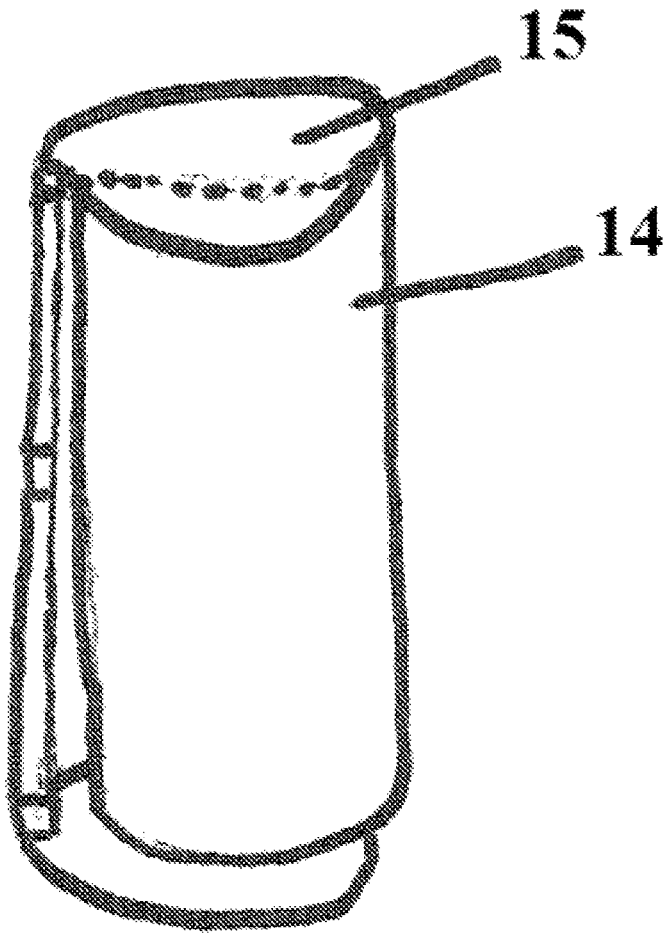
FIG. 2 is a perspective view of the present invention in use.

As illustrated in FIG. 2, the bag holder supports a strong 0.2 mm thick 55 gallon plastic bag 14, measuring 3 feet×4 feet. The bag has an opening 15.

Figure 3:
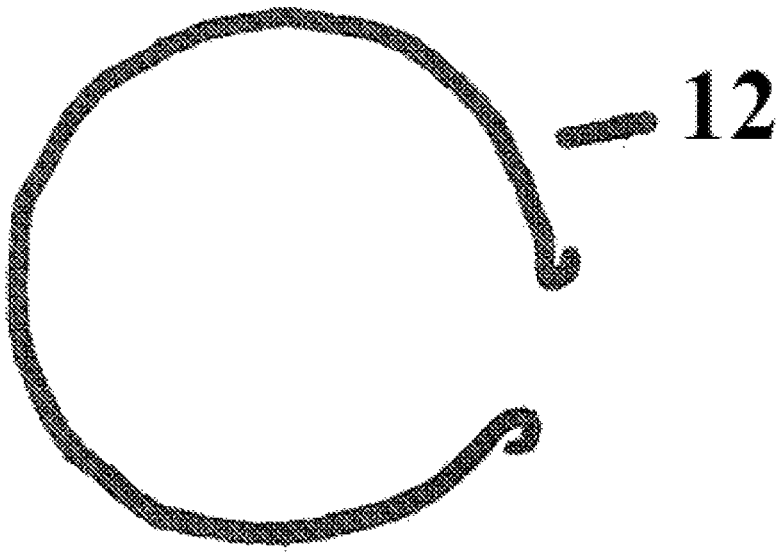
FIG. 3 is a top view of the stretching lock strap.

FIG. 3 shows a top view of the stretching lock strap 12 which is received in the external groove of the top collar 10.

The invention claimed is:

1. A bag holder device consisting of:

a round baseplate having a countersunk bottom configured to allow level setting of the bag holder device and stability, and a female socket at a rear portion;

a bottom vertical support removably secured to said baseplate via a male insert, wherein the bottom vertical support has a length of 17 inches;

a top vertical support removably secured to a female socket of said bottom vertical support, wherein the top vertical support has a length of 17 inches;

a collar removably secured to said top vertical support, wherein the collar has a top edge, a bottom edge, and a throat opening configured to receive a plastic bag, wherein a top of the throat opening has a width of 6 inches and a bottom of the throat opening has a width of 10 inches, such that the throat opening forms two slanted edges each extending between the top edge and bottom edge on either side of the throat opening, wherein the collar has a diameter of 18 inches and a width between the top edge and bottom edge of 3 inches;

a stretching lock strap having a length of 56.5 inches and being configured to stretch around said collar to removably secure the plastic bag to the bag holder device; and wherein said collar has an external 0.5 inch wide groove to accommodate the stretching lock strap.

* * * * *